US007154441B2

(12) United States Patent
Hansen et al.

(10) Patent No.: US 7,154,441 B2
(45) Date of Patent: Dec. 26, 2006

(54) DEVICE FOR TRANSMITTING OR EMITTING HIGH-FREQUENCY WAVES

(75) Inventors: Thomas Hansen, Hildesheim (DE); Martin Schneider, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/514,262

(22) PCT Filed: Jul. 17, 2003

(86) PCT No.: PCT/DE03/02408

§ 371 (c)(1),
(2), (4) Date: Nov. 12, 2004

(87) PCT Pub. No.: WO2004/030141

PCT Pub. Date: Apr. 8, 2004

(65) Prior Publication Data

US 2005/0219123 A1 Oct. 6, 2005

(30) Foreign Application Priority Data

Sep. 23, 2002 (DE) ..... 102 44 206

(51) Int. Cl.
*H01Q 1/38* (2006.01)

(52) U.S. Cl. ..... 343/700 MS; 343/767

(58) Field of Classification Search ..... 343/700 MS, 343/702, 767, 845–848
See application file for complete search history.

(56) References Cited

U.S. PATENT DOCUMENTS 4,197,544 A * 4/1980 Kaloi ..... 343/700 MS
4,531,130 A * 7/1985 Powers et al. ..... 343/700 MS
5,241,321 A 8/1993 Tsao ..... 343/700 MS
6,181,279 B1 * 1/2001 Van Hoozen ..... 343/700 MS
6,492,947 B1 * 12/2002 Anderson ..... 343/700 MS
6,801,167 B1 * 10/2004 Shibata ..... 343/700 MS
2002/0044098 A1 4/2002 Von Stein et al. .... 343/700 MS
2002/0163468 A1 11/2002 Anderson ..... 343/700 MS
2004/0113840 A1 * 6/2004 Gottwald et al. .... 343/700 MS

FOREIGN PATENT DOCUMENTS

WO 03/052686 A2 6/2003

* cited by examiner

*Primary Examiner*—Hoang V. Nguyen
*Assistant Examiner*—Ephrem Alemu
(74) *Attorney, Agent, or Firm*—Michael J. Striker

(57) ABSTRACT

A device for transmitting or emitting high-frequency waves includes: a microstrip line (10) with one end (10') in a substrate (11) for transmitting high-frequency useful signals; a first ground surface (12) and a second ground surface (13), which are provided on opposite sides of the microstrip line (10), for forming a TEM waveguide assembly; an opening (14) in the first ground surface (12) located at a predefined distance (d) from the end of the microstrip line (10') for decoupling a high-frequency signal; a feedthrough device (15) for conductively connecting the first ground surface (12) with the second ground surface (13) on the lateral periphery of the microstrip line (10); and a planar coupling device (16) for receiving and transmitting or emitting the high-frequency useful signal. The feedthrough device (15) is configured in such a way that at a given frequency (f) it prevents the propagation of waveguide modes and excitation of waveguide mode resonance in the useful frequency band (F).

22 Claims, 4 Drawing Sheets

DEVICE FOR TRANSMITTING OR EMITTING HIGH-FREQUENCY WAVES

CROSS-REFERENCE

The invention described and claimed hereinbelow is also described in PCT/DE 03/02408, filed Jul. 17, 2003 and DE 102 44 206.1, filed Sep. 23, 2002. This German Patent Application, whose subject matter is incorporated here by reference, provides the basis for a claim of priority of invention under 35 U.S.C. 119 (a)–(d).

BACKGROUND OF THE INVENTION

The present invention relates to a device for transmitting or emitting high-frequency waves.

Devices for emitting electromagnetic waves, such as planar antenna elements, which are excited using a slot aperture for producing oscillation and, therefore, emitting high-frequency waves, have become widespread in radio link technology, satellite communications technology, and radar technology. They are used preferably in the microwave range, since this allows small component sizes and, therefore, simple realizations at low cost.

A common planar antenna device is presented with reference to FIG. 6A, in which a slot coupling is excited via a microstrip line (MSL) 10. To this end, microstrip line 10 has an abrupt end 10' and therefore forms an open-ended line. A slot 14 is located in a ground surface 12 separated by a substrate 11, perpendicular to microstrip line 10, at a distance d of approximately ¼ of the line wavelength from abrupt end 10' of microstrip line 10. Passage, i.e., coupling, of the magnetic field, which is at a maximum at this point, takes place through said slot. This field, which is also provided with an electrical field component, excites a planar antenna element 16—also called a patch element—to produce sympathetic vibration and nearly complete emission of high-frequency energy with a main direction of propagation which is orthogonal to ground surface 12. FIG. 6B shows a top view of the cross-section of the device according to FIG. 6A.

The disadvantage of this arrangement is that microstrip line substrates 11 become very thin at higher frequencies, e.g., 254 μm in a short range radar application (SRR) at 24 GHz, and do not have adequate structural stability to be expanded upon. For this reason, these substrates 11 must be joined with a rigid carrier material 18, as shown in FIG. 7A. For reasons of cost, this carrier material 18 is not suitable for use in high-frequency applications. Carrier material 18 is placed above ground surface 12 with a permanent connection therewith, and a cost-intensive recess 19 must be created in carrier material 18 to ensure that the antenna is capable of functioning in the region of coupling slot 14 or antenna element 16, so that antenna element 16 can be electromagnetically coupled via coupling slot 14.

To feed single antenna 16, a further conventional embodiment of a slot-coupled antenna uses a "buried" signal-carrying line 10 with an abrupt line end 10' which is configured in the form of a "triplate line" and excites individual antenna 16 to produce emissions, also via a slot 14. Signal line 10 is located substantially plane-parallel between two ground surfaces 12, 13, whereby in the case shown in FIGS. 8A and 8B, microstrip line 10 is located closer to one of the two ground surfaces 12, 13, which results in an antenna arrangement with asymmetrical triplate feeding. In contrast, there are also arrangements with symmetrical feeding, i.e., embedded signal line 10 is equidistant between outer ground surfaces 12, 13. The symmetrical or asymmetrical triplate arrangement has the advantage that larger line elements can be hidden in a lower layer as buried structures, to reduce component size. When larger antennas are to be realized in particular which are composed of a large number of such individual antennas 16 in order to increase the directivity of the antenna, locating high-frequency line arrangements in layers located further downward make compact assemblies possible, since the feeding network of an antenna array takes up a significant portion of the required installation space.

Moreover, a buried feeding network does not negatively influence the emission characteristics of an arrangement of this type, in contrast to "open" distribution and feeding networks, in particular, which make a considerable contribution to parasitic emissions. Another advantage is the possibility of providing easily manufactured, multilayer arrangements, since their single layers have good high-frequency properties and carry the particular line structures to be buried. When suitable layer or substrate materials are used, such as ceramics, the connection with an additional mechanical carrier can be eliminated, since the multilayer arrangement has adequate structural stability. Low temperature co-fired ceramic (LTCC) substrates are particularly well-suited for use in this field.

The antenna arrangement described with reference to FIGS. 8A and 8B has the disadvantage, however, that the release of waves from an abrupt end 10' of signal-carrying, center line 10 of the triplate structure is greatly enhanced. A considerable portion of the signal power can then disadvantageously propagate in substrate material 11, e.g., in the form of parallel plate modes or waveguide modes. If the multilayer arrangement is mounted laterally in a metallic carrier or housing, the excitation of waveguide modes is further enhanced. The propagation of waveguide modes is determined by their limiting frequency $f_g$, the value of which depends directly on the distances from the bordering metallic walls.

The following relationship applies in general: Limiting frequency $f_g$ of a waveguide mode is shifted toward lower frequencies when the distance from electrically conductive, e.g., metallic, walls is increased. At the same time, the number of modes capable of propagating in a certain frequency band increases continually. If modes of this type are now excited in substrate 11 by open-ended line ends, the power emitted via antenna element 16 is reduced and couplings with other circuit parts within substrate 11, e.g., further antenna elements, are enhanced. This has a disadvantageous effect on the antenna characteristics and the overall system behavior.

SUMMARY OF THE INVENTION

Compared to the known means of attaining the goal of the invention, the device according to the present invention for transmitting or emitting high-frequency waves having the features of claim 1 has the advantage that excitation of substrate or waveguide modes in a slot-coupled antenna arrangement with a symmetrical or asymmetrical triplate line is prevented or reduced to an extent which is no longer relevant to the behavior of the antenna or the system, without negatively influencing the basic mode of operation of a slot-coupled emission device.

The device according to the present invention enables a cost-effective improvement of the functionality of the antenna, since suppression of the described excitation of substrate or waveguide modes contributes to an improvement in the antenna efficiency and, therefore, system behavior.

The idea on which the present invention is based essentially consists of providing a shielding measure in the region of the signal line and the coupling slot, and of adjusting its dimensions to fulfill the requirements of each.

In other words, a device for transmitting or emitting high-frequency waves is provided which includes a microstrip line provided with an end in a substrate for transmitting high-frequency useful signals, a first ground surface and a second ground surface which are provided on diametrically opposed sides of the microstrip line to shield the microstrip line, an opening in the first ground surface at a predefined distance from the end of the strip line for decoupling a high-frequency signal, a feedthrough device for conductively connecting the first ground surface with the second ground surface on the periphery of the microstrip line to shield the same (e.g., using "via holes"), and a planar coupling device for receiving and transmitting the high-frequency useful signal, whereby the feedthrough device is structured and/or dimensioned such that, at a given frequency of the useful signal, no waveguide modes occur in the substrate which are capable of propagation or resonance.

Advantageous further developments and improvements of the device indicated in Claim 1 are provided in the subclaims.

According to a preferred further development, the structure of the feedthrough device widens in the region of the coupling opening. This results in the advantage that coupling to an antenna element (patch) is not hindered by the shielding feedthrough device in the region of the coupling opening.

According to another preferred further development, a distance a between diametrically opposed feedthrough devices in the region of the microstrip line is less than the quotient $c_0 \div (2 \cdot f \cdot \sqrt{\epsilon_r})$ whereby $C_0$ stands for the speed of light in a vacuum, $\epsilon_r$ stands for the dielectric permittivity of the substrate, and f stands for the frequency of a useful signal. This advantageously prevents the following from being formed: A first waveguide mode—which is capable of propagating—of a rectangular waveguide, which is approximately what is present here ($TE_{10}$ mode), a mode with a transverse electrical (TE) field, as viewed in the cross section.

According to another preferred further development, the following relationship exists between the width B between diametrically opposed feedthrough devices in the region of the coupling opening and length L of the feedthrough device in the region of the coupling opening:

$$L < \frac{1}{\sqrt{\left(\frac{2 \cdot f_{res} \cdot \sqrt{\varepsilon_r}}{c_0}\right)^2 - \left(\frac{1}{B}\right)^2}}$$

whereby $C_0$ stands for the speed of light in a vacuum, $\epsilon_r$ stands for the dielectric permittivity of the substrate, and $f_{res}$ stands for a resonant frequency of an excitable waveguide mode which is to be provided above a useful signal frequency band. This is an advantage in terms of defining the dimensions for the feedthrough or via walls in the region of the coupling slot, since it prevents undesired resonance frequencies from forming cavity resonance effects within the shielding walls in the region of the coupling slot.

According to another preferred further development, the resonant frequency is approximately a few percent higher than the useful signal frequency band. Resonance phenomena are reliably prevented in this manner.

According to another preferred further development, the device for useful signals is designed with a frequency band between 20 GHz and 30 GHz. The device is suitable for use in a SRR (short range radar) application, for example.

According to another preferred further development, the feedthrough device is composed of discrete feedthrough elements which are located laterally adjacent to each other, preferably forming a wall which acts as an electromagnetic shield. This provides the advantage of good shielding with feedthrough elements which are economical to manufacture, whereby the distance is selected depending on the frequency.

According to another preferred further development, the discrete feedthrough elements are round and/or cylindrical in shape. A simple manufacturing procedure can be ensured as a result.

According to another preferred further development, the feedthrough device is a continuous wall. This provides the advantage of a closed shielding device, e.g., in the form of a metallic layer, which prevents virtually all electromagnetic in-coupling and decoupling.

According to another preferred further development, the feedthrough device is made continuous in the region longitudinally adjacent to the end of the strip line. Advantageously, the strip line is completely shielded.

According to another preferred further development, the feedthrough device is provided with a gap in the region longitudinally adjacent to the end of the strip line. As a result, virtually no electromagnetic radiation is emitted or absorbed, and manufacturing outlay is reduced slightly.

According to another preferred further development, the microstrip line is located closer to the ground surface with the coupling opening than to the other ground surface in the substrate, or vice versa. This provides the advantage of an asymmetrical structure, which is necessary, e.g., when coupling a further microstrip line via the coupling opening.

According to another preferred further development, the microstrip line is located nearly equidistantly between the ground surface with the coupling opening and the other ground surface in the substrate. This provides the advantage of a simple arrangement.

According to another preferred further development, the planar coupling device forms a second microstrip line in another plane which is provided—with galvanic separation—to electromagnetically couple-in this additional microstrip line. In this manner, a signal transmission device, with galvanic separation, is advantageously provided.

According to another preferred further development, the two microstrip lines are substantially identical in configuration, and they overlap in the longitudinal direction by a two-fold predefined distance, which preferably corresponds to nearly half the wavelength of the coupling useful signal. Maximum electromagnetic coupling between the two microstrip lines is therefore ensured.

According to another preferred further development, the coupling opening is arranged parallel to the ground surface in the shape of a slot and/or rectangle. This makes it possible to develop a simple layout of the coupling opening in the ground surface which is economical to manufacture, and offers good decoupling and in-coupling through the slot.

BRIEF DESCRIPTION OF THE DRAWING

Exemplary embodiments of the present invention are presented in the drawing and are described in greater detail below in the subsequent description.

FIG. 5A is a longitudinal sectional view.

FIG. 6A is a longitudinal sectional view.

FIG. 7A is a longitudinal sectional view and FIG. 7B is a top view; FIG. 8A is a longitudinal sectional view and FIG. 8B is a cross-section along cutting plane A.

DETAILED DESCRIPTION OF THE EMBODIMENTS

Figure 1:
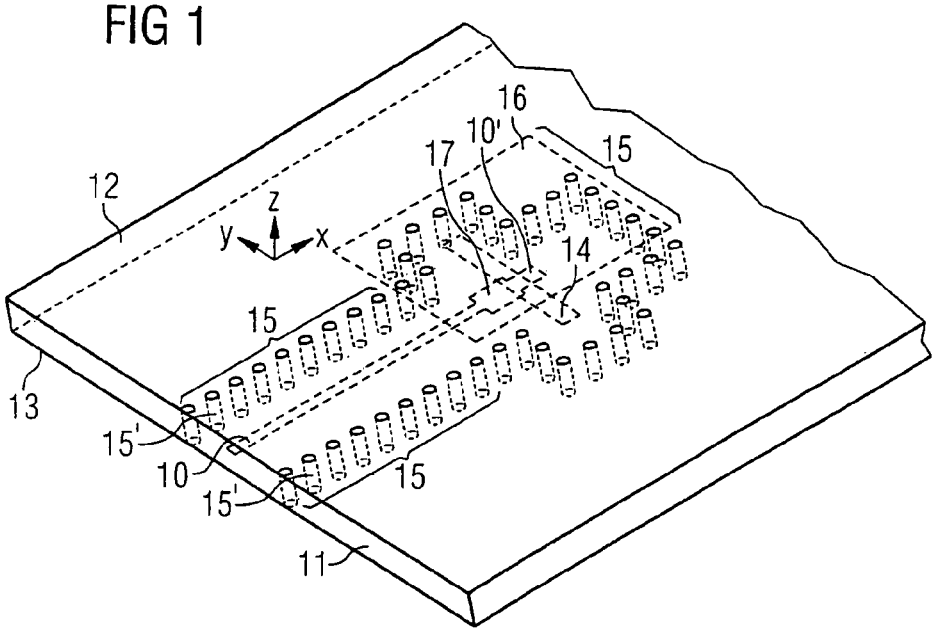
FIG. 1 shows a diagonal view of a section for explanation of a first embodiment of the present invention.

In the figures, the same reference numerals are used to label components which are identical or have the same functionality.

FIG. 1 shows a schematic diagonal view of a slot-coupled antenna device for explanation of a first embodiment of the present invention.

In FIG. 1, a microstrip line 10 is embedded in a substrate 11. This substrate is preferably suitable for high-frequency use and has a low temperature co-fired ceramic (LTCC), for example, which has good dielectric properties with low attenuation. A first ground surface 12 is provided above microstrip line 10, preferably parallel therewith, and is separated by substrate 11.

The lower section of the arrangement shown is formed by a second ground surface 13 which, identical to the first ground surface, is composed of an electrically conductive material, preferably including a metal. First ground surface 12 includes a coupling opening 14 which preferably has the shape of a rectangle and/or a slot, and which has a predefined distance d (not shown) relative to an abrupt end 10' of microstrip line 10. This coupling opening 14 is oriented in the Y direction in the center of strip line 10 or the end of strip line 10', and extends at a right angle thereto, in the shape of a cross. The predefined distance in the X direction between slot opening 14 and end 10' of strip line 10 corresponds to nearly one-fourth of the line wavelength, i.e., $\lambda/4$, of the useful signal f transmitted on strip line 10, which has a bandwidth of frequency band F in the range between 20 GHz and 30 GHz in this example.

A feedthrough device 15 is provided between the top ground surface 12, in which coupling slot 14 is provided, and lower ground surface 13, the feedthrough device being composed according to the present invention out of individual feedthrough elements 15'. Individual feedthrough elements 15' are preferably configured round and/or cylindrical in shape, and provide a shielding device similar to a palisade wall.

In this case, a planar coupling device 16 serves as planar antenna, which is excited to produce resonance by the electromagnetic field decoupled through coupling opening 14. Planar coupling device 16 is oriented preferably parallel to coupling opening 14. The side edges of planar element 16, which is rectangular in this case, are also oriented preferably parallel to the edges of coupling opening 14, i.e., in the X and Y direction. According to the present embodiment, microstrip line 10 includes an impedance transformer 17 in the region of coupling slot 14 and before abrupt end 10' of the strip line, the impedance transformer being used as necessary. Feedthrough device 15 widens in the region of coupling slot 14 and then, longitudinally adjacent to end section 10' of strip line 10, comes back together again and therefore forms a closed shielding device.

A feedthrough device 15 or continuously closed shielding walls around strip line 10 are suited for shielding triplate lines of this type and, consequently, preventing the formation of waveguide modes in substrate 11 which are capable of propagation or resonance. Instead of providing massive walls, it is advantageous in practice to provide feedthrough device 15 in the form of individual feedthroughs 15' (via holes), which, on the high frequency side, form a nearly continuous, electrically conductive wall by way of a sufficiently small lateral distance of the via holes relative to each other. The maximum shielding effect is determined by the correct dimensioning of the distance and diameter of the individual feedthrough elements 15'. To now prevent waveguide modes capable of propagation or resonance, the distance separating the walls, i.e., the distance between the feedthrough device lying on one side of strip line 10 and the distance of feedthrough device 15 lying in the Y direction on the other side of the strip line must not exceed a certain value.

The first waveguide mode—which is capable of propagating—of a rectangular waveguide, which is approximately what is present here, is the $TE_{10}$ mode, a mode with a transverse electrical (TE) field as viewed in the cross section. The limiting frequency of this mode is $$f_g = \frac{c_0}{2a\sqrt{\varepsilon_r}}, \tag{1}$$

whereby $C_0$ is the speed of light in a vacuum ($C_0=3\cdot10^8$ m/s), a is the distance of feedthrough devices 15 or via walls, and $\epsilon_r$ is the dielectric permittivity of the substrate material. It follows that the inequality $$a < \frac{C_0}{2\cdot f_g\cdot\sqrt{\varepsilon_r}} \tag{2}$$

must be fulfilled, so that a waveguide mode is not excited up to frequency $f_g$. Distance a can be reduced depending on the electrical effect of the shape of the via holes or their distances, and the additional (relatively slight) influence of signal line 10.

If this via wall 15 would now be designed to follow signal line 10 in parallel at a corresponding distance a, wall 15 would intersect orthogonally oriented coupling opening 14 in the region of coupling opening 14; as a result, the mode of operation of coupling slot 14 and, therefore, the antenna or transmission device would no longer be ensured. It is therefore necessary to markedly increase the distance of via walls in the vicinity of coupling slot 14 and then to reduce it after slot 14 in the region of open-ended signal line 10'. The via walls 15 could then be brought together after the open-ended end 10' of microstrip line 10, although this is not necessarily required, since excitation of the substrate or waveguide modes would not be possible due to the small distance present there. To achieve a maximum shielding effect, and to prevent electromagnetic in-couplings into the arrangement from the outside, feedthrough devices 15, i.e., the walls, are preferably brought back together longitudinally adjacent to open-ended signal line 10'.

With regard for the dimensioning or structuring of feedthrough device 15 or via walls in the region of coupling opening 14, it must be taken into consideration that, when distance a of these walls is increased, limiting frequency $f_g$ of waveguide mode becomes lower and, in fact, generally below the useful frequency f of the antenna itself. As a result, interference of the functionality of coupling opening 14 by via walls 15 is minimal or negligible in a draft version of the arrangement. On the other hand, this presents the risk that cavity resonance effects can form within these shielding walls 15 with the greatly increased distance B in the region of coupling opening 14, the cavity resonance effects greatly impairing the functionality of the antenna if these undesired resonance frequencies, which may occur, are in the useful frequency range. To deliberately prevent this, an appropriate length L of via walls 15 in the X direction is selected in the region of the coupling opening with the larger distance B of shielding walls 15 in the Y direction.

In a completely closed, dielectrically filled, rectangular waveguide resonator having width B, height H and length L with ideally conductive electrical walls, possible discrete resonance frequencies result according to the following relationship:

$$f_{res} = \frac{c_0}{2\sqrt{\varepsilon_r}}\sqrt{\left(\frac{p}{L}\right)^2 + \left(\frac{m}{B}\right)^2 + \left(\frac{n}{H}\right)^2} \tag{3}$$

whereby p, m and n are whole-numbered indices, $C_0$ is the speed of light in a vacuum, and $\epsilon_r$ is the dielectric permittivity of the non-conductive filler material. For the $TE_{10}$ mode, which is relevant here, m=1 and n=0. As a result, the possible resonance frequencies depend on width B but not on height H. The whole-numbered index p must be greater than zero in TE modes. This results in the first excitable cavity resonance of the $TE_{10}$ mode according to $$f_{res} = \frac{c_0}{2\sqrt{\varepsilon_r}}\sqrt{\left(\frac{1}{L}\right)^2 + \left(\frac{1}{B}\right)^2} \tag{4}$$

In designing the antenna with slot coupling and via-hole shielding 15 of signal line 10, it must be noted that, although the limiting frequency of the waveguide-like resonance according to equation (1)—whereby "a" must then be made equal to "B"—can be below the useful signal frequency band F, but the first resonant frequency according to equation (4) must be above the useful signal frequency band F to prevent interference with the mode of operation of transmission device 16 and/or the antenna.

Moreover, with the present embodiment according to FIG. 1, it should be noted that, when designing the dimensions of the shielding device or feedthrough device 15, the use of discrete feedthrough elements 15' with a certain lateral distance relative to each other instead of closed metallic walls influences the limiting frequency of the waveguide modes. It must also be taken into consideration that the resonator does not have any fully-closed walls in the region of the coupling slot, as they do in the theoretical model, but rather large-area in-couplings and decouplings, e.g., in the region where via walls 15 widen, which influence the resonant frequency accordingly. The coupling slot 14 itself also influences the resonant frequency, and open-ended signal line 10, 10' below coupling opening 14 can change the resonant frequency.

Figure 2:
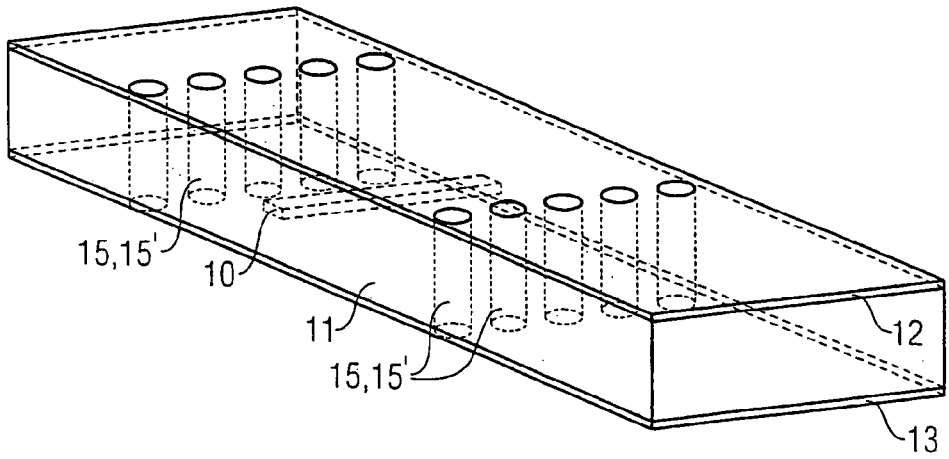
FIG. 2 shows a diagonal view for explanation of the first embodiment of the present invention.

FIG. 2 shows a schematic diagonal view for explanation of the first embodiment of the present invention.

A section of the arrangement according to FIG. 1 is shown in FIG. 2. Microstrip line 10 is embedded in a dielectric substrate between a first ground surface 12 and a second ground surface 13. The two ground surfaces 12, 13 are connected with each other via electrically conductive feedthrough elements 15' which form a feedthrough device 15 or a shielding device. According to the embodiment shown, strip line 10 is arranged plane-parallel and symmetrical between the two parallel ground surfaces 12, 13, i.e., in a symmetrical triplate arrangement. Strip line 10 preferably has a nearly rectangular cross section, while the individual laterally adjacent feedthrough elements 15 are configured in the shape of a cylinder in particular.

Figure 3:
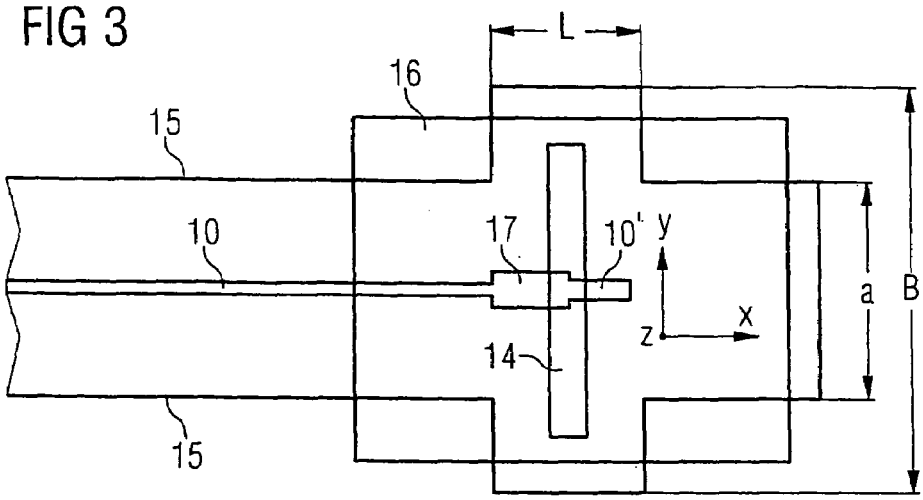
FIG. 3 shows a top view of a schematic radiation device for explanation of a second embodiment of the present invention.

FIG. 3 shows a schematic top view of an antenna device for explanation of a second embodiment of the present invention.

An antenna device according to the invention is shown in FIG. 3, whereby it differs substantially from the embodiment shown with reference to FIG. 1 in that, in this case, feedthrough device 15 does not consist of individual feedthrough elements 15', but rather of continuous electrically conductive walls located between the first and second ground surface, providing electrical contact between the two. The useful frequency band F is preferably in the range of 22 GHz to 26 GHz.

The triplate structure shown in FIG. 3 is asymmetrical, i.e., the distance from substrate 11 over signal line 10 to first ground surface 12 is 150 μm, and the distance of substrate 11 below signal line 10 to second ground surface 13 is, e.g., 450 μm (neither of the ground surfaces are shown in the top view according to FIG. 3). The length of the coupling slot, i.e., its extension in the Y direction, is 2.6 mm, for example, and the dielectric constant $\epsilon_r$ of the ceramic substrate material is $\epsilon_r$=7.7. For the limiting frequency of waveguide mode $TE_{10}$ in the region of signal line 10 with small distance a from feedthrough device 15 or the via walls to now be above the useful frequency band F, the distance a according to equation (2) must be less than 2.46 mm, and is designed to be a=1.9 mm, for example.

To ensure that the electromagnetic coupling through coupling opening 14 is not interfered with by shielding device 15, the distance of via walls B is increased to 3.6 mm, for example, in the region of coupling slot 14. As a result, the limiting frequency $f_g$ of the $TE_{10}$ mode is reduced to approximately 15 GHz, according to equation (1). To ensure that the first resonant frequency $f_{res}$ of this mode is above 27 GHz, for example, which is necessary to ensure a 1 GHz-frequency distance from the useful frequency band F, a length L less than 2.4 mm must be selected, according to equation (4). To also compensate for the influences of resonant frequency $f_{res}$ mentioned above, L is preferably selected to be 1.2 mm in the present exemplary embodiment.

Figure 4:
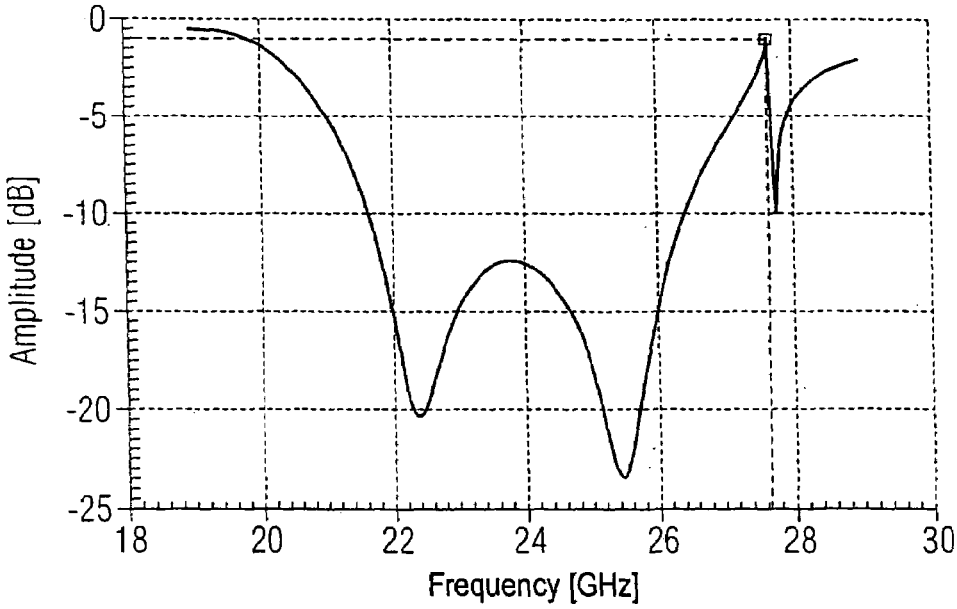
FIG. 4 shows a simulation diagram for explanation of the mode of operation of the radiation device explained with reference to FIG. 3.

FIG. 4 shows the amplitude trace of the reflection factor as a simulation result of a full wave analysis of the entire antenna assembly according to FIG. 3. Resonance clearly appears at approximately 27.7 GHz, since the reflection factor has a high amplitude factor in this case, which corresponds exactly to the described cavity resonance effect of the $TE_{10}$ mode, which is followed by an analysis of associated field distribution images (not shown). At the same time, good reflection attenuation occurs in the useful frequency band F between 22 GHz and 26 GHz, the reflection attenuation being greater than 12 dB; above this, the matching follows a very smooth course. Based on this, interference by other resonance-like effects in this frequency range can be ruled out. The course of the reflection factor can be adjusted as desired in large regions by designing the dimensions or structures of planar coupling device 16 or planar antenna, coupling opening 14 or coupling slot, signal line 10 and impedance transformer 17 accordingly.

Figure 5A:
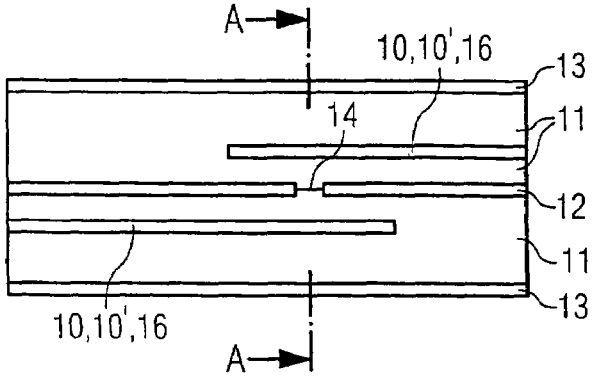
FIGS. 5A, B show a schematic illustration of a galvanically separated coupling device for explanation of a third exemplary embodiment of the present invention, whereby

FIG. 5A shows a coupling device of an electromagnetic signal with galvanic separation. According to this third embodiment of the present invention, two microstrip lines 10 in a dielectric substrate 11 are separated by a ground surface 12 with a coupling opening 14. In the illustration, lower strip line 10 extends toward the left, and has its open-ended end 10' in the region adjacent to coupling opening 14, while upper strip line 10 extends toward the right in the drawing and has its open-ended left end 10' in the region adjacent to coupling slot 14. The arrangement is configured point-symmetric to the center of coupling slot 14.

The arrangement in the lower region corresponds substantially to an asymmetrical triplate feeding, which does not transmit its decoupled field to a planar antenna (16, not shown here), however, but rather to a continuing strip line 10. In this manner, an antenna element is not provided, but rather a coupling device, which transmits the signal via an electromagnetic coupling-in of a signal of a strip line in a plane to a second strip line 10 in another plane, with galvanic separation. The feedthrough device or shielding walls not shown in FIG. 5A have the structures and dimensions in the region of the strip line and, in particular, in the region of the coupling opening 14, as described above.

Figure 5B:
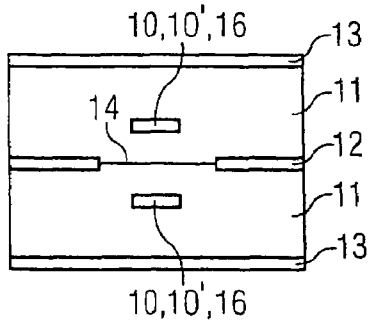
FIG. 5B is a cross-section along cutting plane A.
Figure 6A:
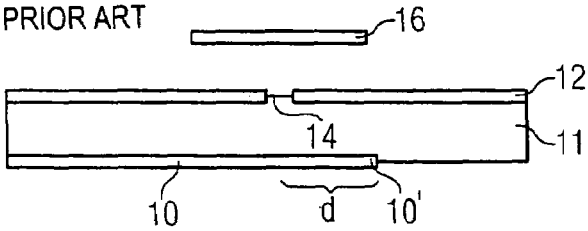
FIG 6A PRIOR ART
FIGS. 6A, B show a schematic illustration of a common slot-coupled planar antenna, whereby
Figure 6B:
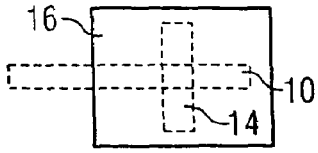
FIG 6B PRIOR ART
FIG. 6B is a top view.
Figure 7A:
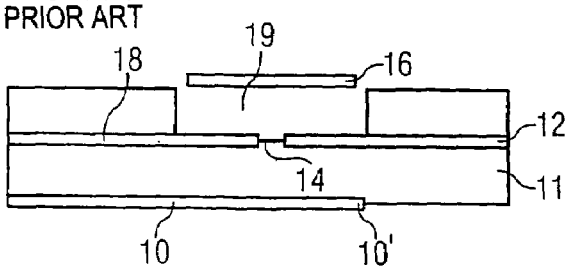
FIG 7A PRIOR ART
FIGS. 7A, B show a schematic illustration of the arrangement presented with reference to FIGS. 6A, B with an additional mechanical reinforcement, whereby
Figure 7B:
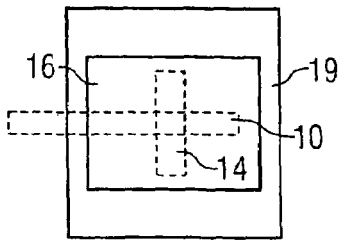
FIG 7B PRIOR ART
Figure 8A:
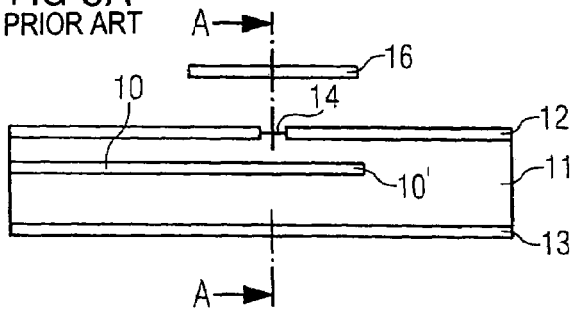
FIG 8A PRIOR ART
FIGS. 8A, B show a schematic illustration of a common slot-coupled planar antenna with an asymmetrical triplate line feeding, whereby
Figure 8B:
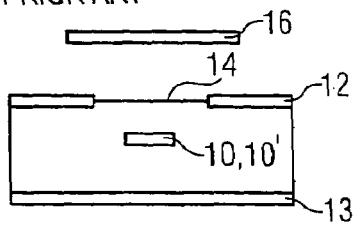
FIG 8B PRIOR ART

The coupling device according to FIG. 5A is shown in cross section in FIG. 5B, whereby the feedthrough device is not shown here, either, to enhance transparency, but it is still located as described above.

Although the present invention was described above with reference to preferred exemplary embodiments, it is not limited to them. Instead, it is capable of being modified in highly diverse manners.

In particular, the materials mentioned for the dielectric substrate, the ground surfaces and strip line are to be regarded as examples. Moreover, the configuration of the coupling slots, the planar coupling device and the strip line are not necessarily rectangular. Instead, they can also have round, oval or polygonal cross sections or top views. The feedthrough device and shielding walls in particular do not have to extend at a right angle to each other; instead, they can have rounded-off transitions.

What is claimed is:

1. A device for transmitting or emitting high-frequency waves with:

a microstrip line (10) provided with one end (10') in a substrate (11) for transmitting high-frequency useful signals;

a first ground surface (12) and a second ground surface (13), which are provided on opposite sides of the microstrip line (10), for forming a TEM waveguide assembly;

an opening (14) in the first ground surface (12) located at a predefined distance (d) from the end of the microstrip line (10') for decoupling a high-frequency signal;

a feedthrough device (15) for conductively connecting the first ground surface (12) with the second ground surface (13) on the lateral periphery of the microstrip line (10); and a planar coupling device (16) for receiving and transmitting or emitting the high-frequency useful signal;

whereby the feedthrough device (15) is configured in such a way that at a given frequency (f) it prevents the propagation of waveguide modes and the excitation of waveguide mode resonance in the useful frequency band (F), wherein the following relationship exists between the width (B) between diametrically opposed feedthrough devices (15) in the region of the coupling opening (14) and the length (L) of the feedthrough device in the region of the coupling opening (14):

$$L < \frac{1}{\sqrt{\left(\frac{2 \cdot f_{res} \cdot \sqrt{\varepsilon_r}}{c_0}\right)^2 - \left(\frac{1}{B}\right)^2}},$$

whereby $C_0$ stands for the speed of light in a vacuum, $\epsilon_r$ stands for the dielectric permittivity of the substrate (11), and $f_{res}$ stands for a resonant frequency ($f_{res}$) of an excitable waveguide mode which is provided above a useful signal frequency band (F).

2. A device for transmitting or emitting high-frequency waves with:

a microstrip line 10 provided with one end (10') in a substrate (11) for transmitting high-frequency useful signals;

a first ground surface (12) and a second ground surface (13), which are provided on opposite sides of the microstrip line (10), for forming a TEM waveguide assembly;

an opening (14) in the first ground surface (12) located at a predefined distance (d) from the end of the microstrip line (10') for decoupling a high-frequency signal;

a feedthrough device (15) for conductively connecting the first ground surface (12) with the second ground surface (13) on the lateral periphery of the microstrip line (10); and a planar coupling device (16) for receiving and transmitting or emitting the high-frequency useful signal;

whereby the feedthrough device (15) is configured in such a way that at a given frequency (f) it prevents the propagation of waveguide modes and the excitation of waveguide mode resonance In the useful frequency band $(F)_A$ wherein a distance (a) between diametrically opposed feedthrough devices (15) in the region of the microstrip line (10) is less than $$\frac{c_0}{2 \cdot f \cdot \sqrt{\varepsilon_r}}$$

whereby $C_0$ stands for the speed of light in a vacuum, $\epsilon_r$ stands for the dielectric permittivity of the substrate (11), and f stands for the frequency (f) of a useful signal.

3. The device as recited in claim 2, wherein the shape of the feedthrough device (15) widens in the region of the coupling opening (14) .

4. The device as recited in claim 2, wherein the device for useful signals is designed with a frequency band (F) between 20 GHz and 30 GHz.

5. The device as recited in claim 2, wherein the feedthrough device (15) forms a continuous wall.

6. The device as recited in claim 2, wherein the feedthrough device (15) is made continuous in the region longitudinally adjacent to the end (10') of the strip line (10).

7. The device as recited in claim 2, wherein the feedthrough device (15) is provided with a gap in the region longitudinally adjacent to the end (10') of the strip line (10).

8. The device as recited in claim 2 wherein the microstrip line (10) is located closer to the ground surface (12) with the coupling opening (14) than to the other ground surface (13) in the substrate (11), or vice versa.

9. The device as recited in claim 2, wherein the microstrip line (10) is located nearly equidistantly between the ground surface (12) with the coupling opening (14) and the other ground surface (13) in the substrate (11).

10. The device as recited in claim 2, wherein the coupling opening (14) is arranged parallel to the ground surface (12, 13) in the shape of a slot and/or rectangle.

11. The device as recited in claim 2, wherein the substrate has a ceramic material.

12. The device as recited in claim 11, wherein the ceramic material is low temperature co-fired ceramic (LTCC).

13. The device as recited in claim 2, wherein the microstrip line (10) includes an integrated impedance transformer (17) in the region of the coupling opening (14).

14. The device as recited in claim 13, wherein the planar coupling device (16) is capable of being brought into resonance with the coupling opening (14) and is therefore capable of being excited to produce emissions.

15. The device as recited in claim 13, wherein the coupling device (16) itself is capable of being brought into resonance and is therefore capable of being excited to produce emissions.

16. The device as recited in claim 2, wherein the feedthrough device (15) is composed of discrete feedthrough elements (15') which are located laterally adjacent to each other.

17. The device as recited in claim 16, wherein the discrete feedthrough elements (15') are round and/or cylindrical in shape.

18. The device as recited in claim 16, wherein the feedthrough device (15) is composed of discrete feedthrough elements (15') which form a wall.

19. The device as recited in claim 18, wherein the resonant frequency ($f_{res}$) has a distance greater than approximately a few percent above the useful signal frequency band (F).

20. The device as recited in claim 2, wherein the planar coupling device (16) forms a second microstrip line (10) in another plane, wherein the other plane is provided, with galvanic separation, to electromagnetically couple-in the second microstrip line (10).

21. The device as recited in claim 20, wherein the two microstrip lines are configured substantially identically and overlap in the longitudinal direction by a two-fold predefined distance (d).

22. The device as recited in claim 21, wherein the two-fold predefined distance (d) corresponds to nearly half the wavelength of the coupling useful signal.

* * * * *